United States Patent [19]

Watt

[11] Patent Number: 4,750,592

[45] Date of Patent: Jun. 14, 1988

[54] ELEVATOR POSITION READING SENSOR SYSTEM

[75] Inventor: Richard E. Watt, San Diego, Calif.

[73] Assignee: United States Elevator Corp., San Diego, Calif.

[21] Appl. No.: 28,390

[22] Filed: Mar. 20, 1987

[51] Int. Cl.[4] ..... B66B 3/02

[52] U.S. Cl. ..... 187/134

[58] Field of Search ..... 187/134

[56] References Cited

U.S. PATENT DOCUMENTS

| | | | |
|---|---|---|---|
| 2,938,603 | 5/1960 | Loughridge | 187/134 |
| 3,486,640 | 12/1969 | Lemelson | 187/134 X |
| 3,815,711 | 6/1974 | Hoelscher | 187/134 X |
| 3,889,231 | 6/1975 | Tosato et al. | 187/134 |
| 4,019,606 | 4/1977 | Caputo et al. | 187/134 |
| 4,203,506 | 5/1980 | Richmon | 187/134 X |
| 4,218,671 | 8/1980 | Lewis | 187/134 |
| 4,245,721 | 1/1981 | Masel | 187/134 |
| 4,427,095 | 1/1984 | Payne et al. | 187/134 |
| 4,433,756 | 2/1984 | Caputo et al. | 187/134 |

*Primary Examiner*—William M. Shoop, Jr.

*Assistant Examiner*—W. E. Duncanson, Jr.

*Attorney, Agent, or Firm*—Brown, Martin, Haller & Meador

[57] ABSTRACT

A system for reading or sensing the position of an elevator relative to a landing and for providing corresponding control signals to a controller for controlling the elevator movement in response to the sensed position comprises a tape veritically mounted in an elevator shaft and having reflective vanes positioned on it to indicate position relative to a landing. Sensors are mounted on the elevator car and produce predetermined output signals in response to detection of vanes, and suitable control circuitry responds to predetermined combinations of the sensor output signals to produce suitable output control signals to a controller which controls the car's speed, direction and positioning. The system is installed by first vertically mounting a suitable tape in an elevator shaft so that it runs through a sensor unit mounted on an elevator cab, and positioning vanes on the tape at predetermined positions relative to each floor.

31 Claims, 8 Drawing Sheets

ELEVATOR POSITION READING SENSOR SYSTEM

BACKGROUND OF THE INVENTION

This invention relates generally to an elevator position sensing and control system, and more particularly involves a method and apparatus for determining the position of an elevator car in an elevator shaft relative to a landing and for controlling the speed of the car and the positioning of the car at a selected landing.

Conventional elevator position sensing systems employ metal vanes which are attached to the elevator shaft wall adjacent of each landing to indicate the approach and location of each landing. Typically the metal vanes protrude into the shaft to a location in the vicinity of the car's path, and magnetic sensors on the car detect the vanes. The detection information is used for controlling the speed and positioning of the car. In such a system a plurality of metal vanes must be installed at each landing, and the installation and alignment of these vanes is very time consuming and therefore expensive.

In U.S. Pat. No. 3,815,711 of Hoelscher a vane control system for elevators is described, in which a light sensor array is used to detect the presence of a vane as it passes through the sensor array to interrupt the illumination of each sensor in turn. Again this involves positioning of vanes in the elevator hoistway adjacent each floor of intended landing.

SUMMARY OF THE INVENTION

According to one aspect of the present invention, an elevator position sensing system is provided which comprises a tape vertically mounted in an elevator shaft, vanes positioned on the tape which are indicative of an elevator position relative to a landing, and sensors mounted on the car for detecting the vanes and producing output signals in response to the vane detection. A logic unit is connected to the sensor outputs to produce elevator speed and position control signals in response to predetermined sensor outputs.

In one specific example of the invention, reflective vanes are positioned on the tape and the sensor unit comprises a plurality of vertically spaced sensors for detecting the vanes. The vanes are positioned to produce landing level signals and floor approach signals for controlling the elevator speed and positioning. The vanes may be provided on one or both sides of the tape. In the preferred arrangement vanes are provided on both sides of the tape and the tape runs through the sensor unit provided with an array of sensors on each side of the tape for detecting the vanes. The unit is preferably provided with suitable guides or recesses for guiding the tape.

According to another aspect of the invention control circuitry is provided for producing various elevator control signals to the elevator drive controller in response to predetermined sensor unit outputs. The control circuitry may be designed to produce output signals compatible with existing elevator controllers of the relay or microprocessor type, or the elevator control itself may be modified to respond to the control circuitry outputs. The control circuitry preferably includes a logic unit or gate array circuit which is connected to the sensor outputs. In a two-floor system the logic unit produces floor approach signals for connection to the elevator controller to slow down the motor speed, and floor level signals for detection by the controller to stop the elevator. In a multi-floor system (3 or more floors), the unit also produces floor number signals for connection to the controller for stopping the elevator at an appropriate floor and for keeping track of the elevator's location at all times. The sensor array and logic unit are preferably provided as an integral unit for mounting on the top of an elevator cab.

According to another aspect of the invention a method of installing an elevator position sensing system in an elevator shaft is provided, which comprises first mounting a sensor array unit on the top of an elevator cab, securing one end of a tape at one end of the elevator shaft, threading the tape through tape guides provided in the sensor array unit, securing the opposite end of the tape to the other end of the elevator shaft so that it extends vertically along the shaft, and providing reflective vanes on the tape at predetermined positions relative to the elevator floor levels. The reflective vanes may be provided either before or after the tape is hung in the shaft, and in the preferred arrangement at least some of the vanes are provided by running the elevator in the shaft to predetermined floor positions after the tape has been hung, marking the tape at the predetermined positions, and then moving the cab so that vanes can be installed. This technique can be used to mark and install the floor level vanes, for example, with the remaining vanes for each floor being installed at predetermined spacings from the floor level vanes. In one method the tape is a reflective tape covered with a matte finish to make it non-reflective, and portions of the non-reflective covering are removed to form the vanes.

This method, therefore, does not require the mounting of vanes on an elevator shaft wall, and the positioning system is much faster and easier to install than previous vane detecting and control systems. The required vanes can easily be positioned and adjusted relative to the sensor unit. The logic unit control outputs can be designed to correspond to the control outputs of previous systems so that they can be connected to standard elevator controllers of either the relay type or the microprocessor type for controlling the elevator drive motor in response to the elevator position signals and elevator floor control signals.

The system preferably includes an arrangement for detecting the elevator position in the event of a power outage. In a two-floor system, this comprises a suitable vane cut out positioned to correspond to one sensor at the top floor and to a different sensor at the bottom floor. In the multi-floor system, floor number code vanes are provided at each floor to produce an output binary code representing the floor number, so that elevator is simply run to the next floor where a floor number reading is taken.

In the preferred embodiment of the invention a single logic unit is provided with suitable circuitry for both two-floor and multi-floor operations, with one or more switches for controlling which type of operation is in effect at any time. Thus the same control circuitry can be provided for each elevator system, with the installer simply positioning one or more switches on the sensor and control unit according to the type of operation required. Thus existing elevator systems can easily be modified for installation of the elevator position sensing system of this invention, and it can also easily be installed in any new elevator system having any number of floors.

BRIEF DESCRIPTION OF THE DRAWINGS

The present invention will be better understood from the following detailed description of some preferred embodiments of the invention, taken in conjunction with the accompanying drawings, in which like reference numerals refer to like parts and in which.

DESCRIPTION OF THE PREFERRED EMBODIMENTS

The elevator position sensing or reading system of this invention is designed for installation in an elevator having two or more floors, and for integration with an elevator controller of the relay or microprocessor type. The system is designed to produce control signals representing the position of an elevator relative to a respective elevator floor for coupling with a relay or microprocessor controller for controlling the elevator speed, direction and positioning. The two-floor installation is the simplest, and that will therefore be described first. However, similar techniques are used in installation of elevator systems for three or more floors, as described in more detail below.

Figure 8:
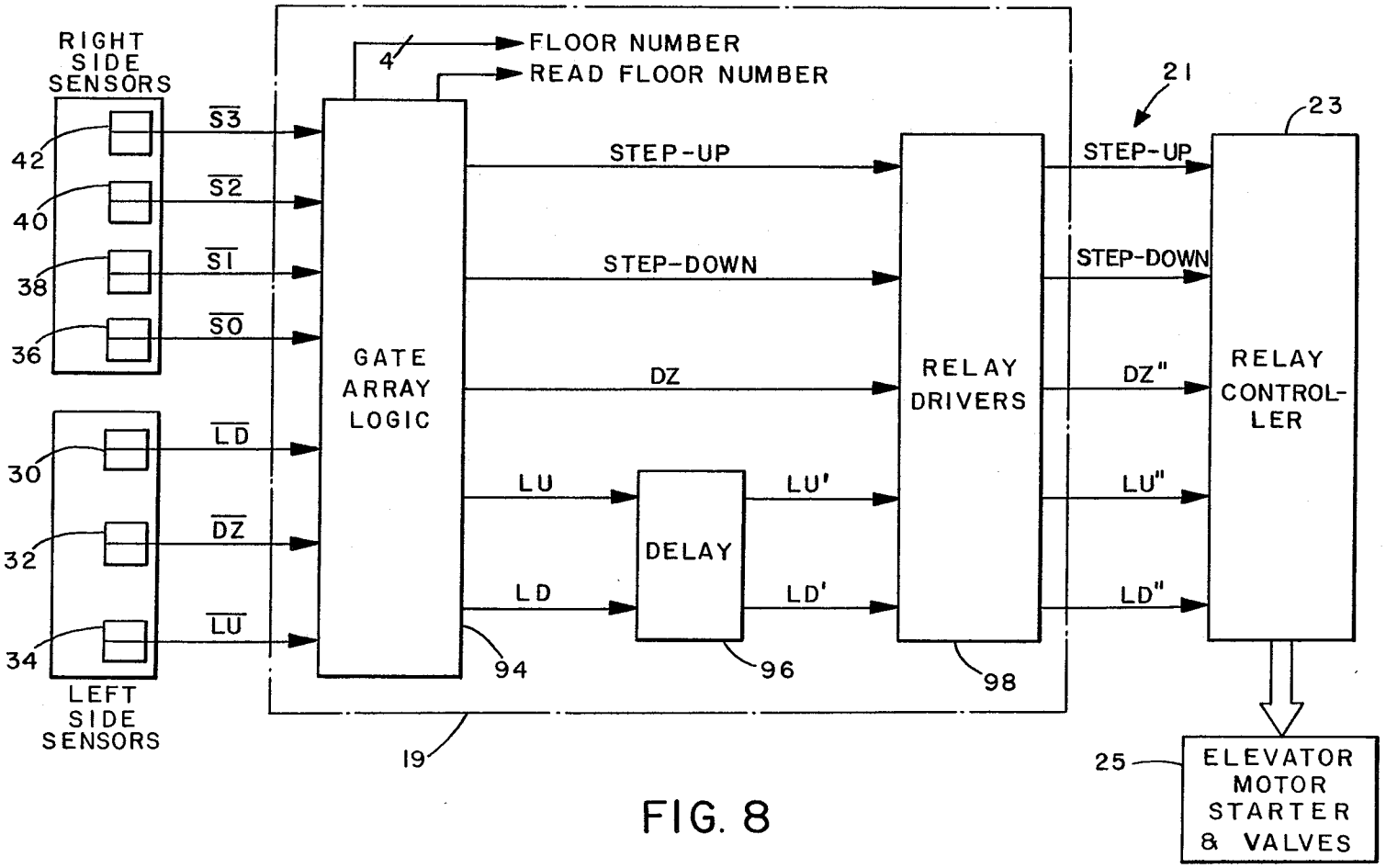
FIG. 8 is a block diagram of an elevator control system incorporating a position sensing system according to a preferred embodiment of the invention, for detecting the sensor outputs and producing corresponding elevator speed and position control signals for connection to a two-floor, or multiple- floor elevator control.

A two-floor elevator system incorporating an elevator position sensing system according to a preferred embodiment of the invention is shown in FIGS. 1 to 6 of the drawings. FIG. 8 is a schematic block diagram illustrating the overall elevator control system incorporating the elevator position sensing system of the invention.

Figure 1:
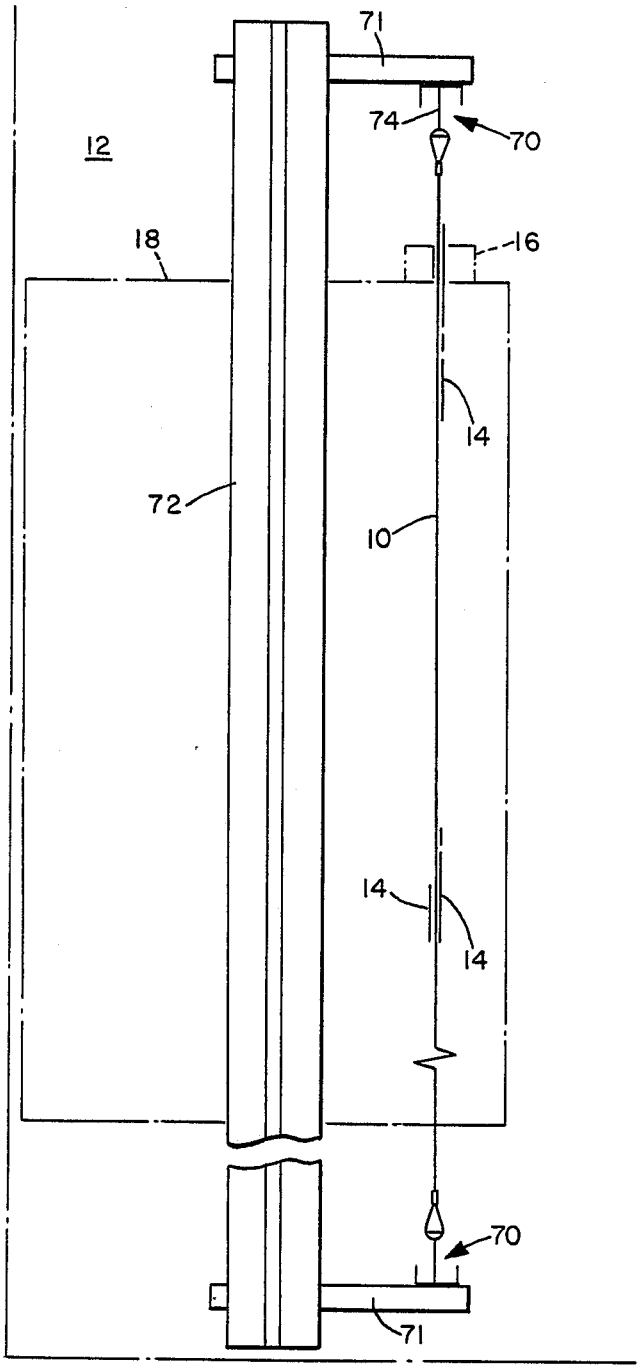
FIG. 1 is a side elevation view showing the installation of a two-floor elevator position sensing system in an elevator shaft according to a first embodiment of the invention.

As best illustrated in FIG. 1, the position sensing system basically comprises a tape 10 which runs vertically from the top to the bottom of an elevator shaft 12, the tape having a plurality of vanes 14 positioned on one or both of its side faces to provide an indication of the floor location, and a sensor unit 16 mounted on the top of the elevator car 18, which includes a sensor assembly for detecting the vane positions. As shown in FIG. 8, control logic circuitry 19 is connected to the sensor outputs for communicating appropriate output control signals 21 to elevator controller hardware 23 for controlling the elevator motor 25, and thus the movement of the elevator car. The system allows the location of the car to be determined and the speed of the car to be slowed from its normal running speed to a leveling speed on approaching a desired floor, and allows the car to be precisely positioned at a particular landing.

Figure 3:
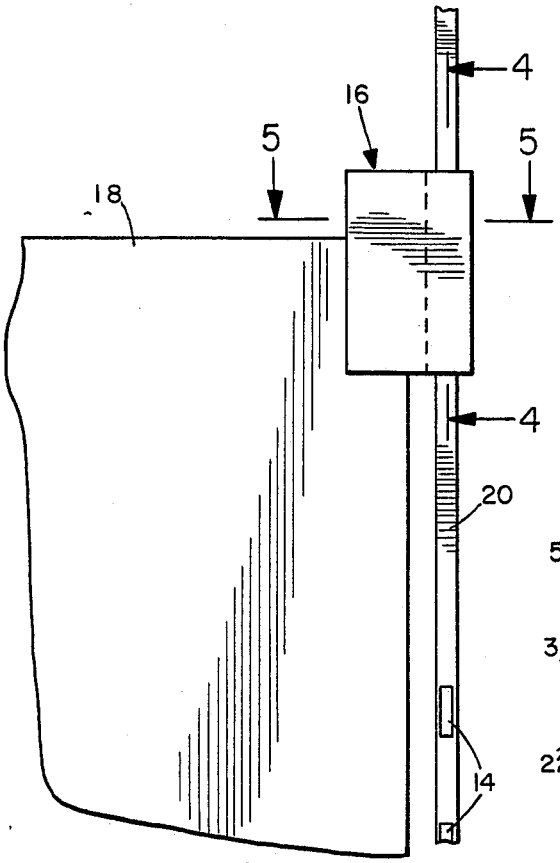
FIG. 3 is side elevation view showing the sensor unit mounted on an elevator car with the position indicating tape extending through the sensor unit.
Figure 5:
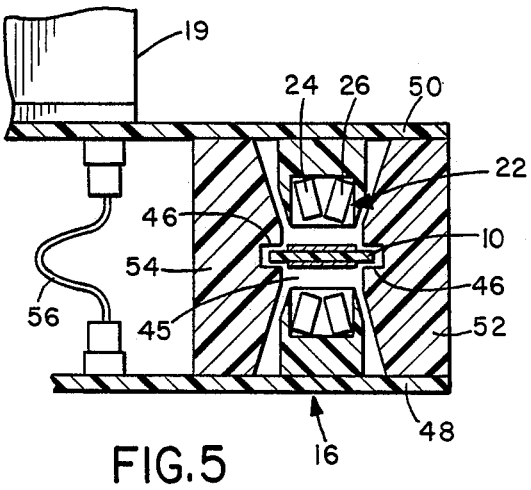
FIG. 5 is an enlarged sectional view taken on the line 5—5 of FIG. 3.
Figure 4:
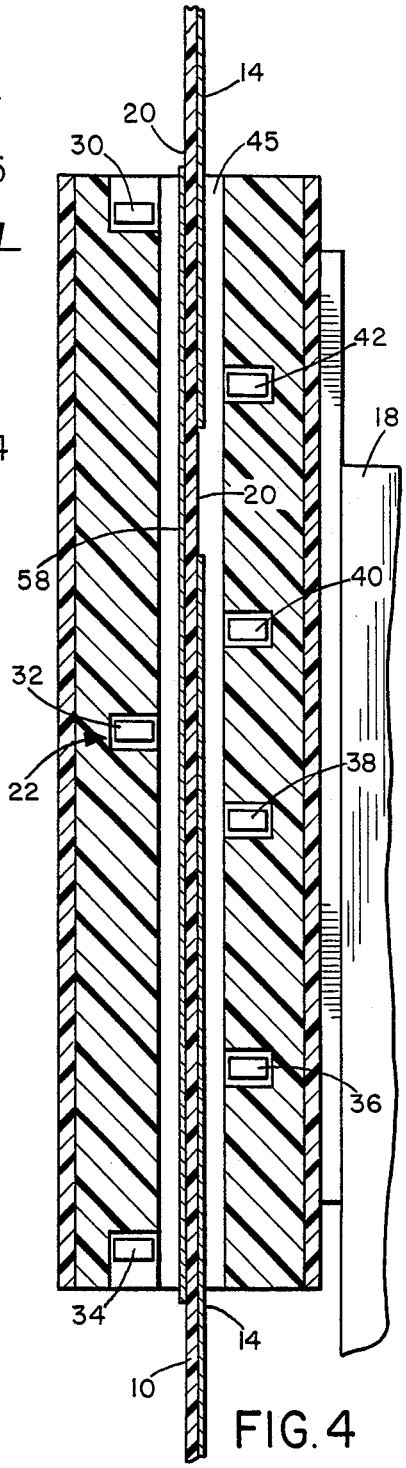
FIG. 4 is an enlarged sectional view taken on the line 4—4 of FIG. 3.

In the preferred embodiment of the invention the vanes 14 are lengths or strips or reflective material positioned on an otherwise non-reflecting tape surface 20, as shown in FIGS. 3 to 5 and the sensor assembly comprises a series of sensors 22 each comprising a light source 24 and a light detector 26 positioned to detect light reflected from a vane. The sensors may comprise infrared LED sensor units, for example, or any other suitable light sensor unit. The term "vane" is used for consistency with the old terminology used in systems employing vanes mounted in the elevator shaft adjacent each floor. The sensors are connected to suitable logic circuitry 19, described in more detail below, for producing suitable elevator control signals in response to the detected sensor outputs. The control logic circuitry is preferably provided in the sensor unit 16 for mounting on the top of an elevator, as best shown in FIG. 5. However, the sensor assembly and control logic circuitry may be provided as separate units if desired. Sensor unit 16 may be mounted at the bottom of the elevator instead of at the top as shown in the drawings.

The installation of a two-floor elevator position sensing system will first be described, with reference to FIGS. 1 to 6. The tape in the preferred embodiment has vanes or strips on both of its faces. The sensor assembly includes a first array of three vertically spaced sensors 30, 32 and 34 for detecting the vanes on one face of the tape. These sensors are generally referred to as floor level sensors and in the illustrated embodiment are directed at the left hand face of the tape as shown in the drawings, with the vanes on that face of the tape comprising floor level vanes. A second array of four vertically spaced sensors 36, 38, 40 and 42 is provided for detecting the vanes on the opposite, or right hand face of the tape. These are the floor approach and floor number sensors, with the vanes on the right hand face of the tape which are detected by those sensors comprising floor approach vanes or step up and step down vanes, as explained in more detail below with reference to FIG. 6. Clearly the sensor arrays and vanes could be reversed to opposite sides of the tape in alternative arrangements, and the faces are termed left and right face for convenience only.

The spacing between the sensors in the two arrays and the length and spacing between the respective vanes on opposite sides of the tape are used to generate specific output signals or pulses representative of the elevator reaching the level of a floor, or "door zone", and signals representing the approach of a floor, and the actual floor location (which in the case of a two- floor elevator system will be either the top or the bottom floor of the elevator). Thus, certain combinations of the door zone sensor outputs will indicate that the elevator is level at a floor, while certain combinations of the floor location or floor approach sensors will indicate the approach of a floor or the location of a floor, as explained in more detail below. Although in the two-floor system described it is not really necessary to have four sensors for the right hand side of the tape, for the purposes of determining the floor number, it is necessary for step up and step down detection and also so that the two-floor and multi-floor systems can use substantially the same logic circuitry and a single sensor and logic unit can be provided for any elevator, with suitable switches for converting the unit for two-floor or multi-floor systems, as explained below.

The installation of a two-floor system will first be described in detail. The sensor unit 16 is first installed on the top of the elevator car as shown in FIG. 3 so that it projects out several inches from one face of the car. It may be installed at other points on the elevator car if desired. Outputs from the control logic unit are suitably connected to an elevator motor controller, as will be explained in more detail below.

Sensor unit 16 has a vertically extending through bore or passageway 45 defined between opposite faces of the unit in which the two sensor arrays are mounted, as best shown in FIGS. 4 and 5. The passageway is dimensioned so that the tape 10 can extend vertically through it with opposite faces of the tape facing the opposite sensor arrays. Preferably, guideways or recesses 46 are provided in the passageway for locating and guiding opposite side edges of the tape running through the passageway, as indicated in FIG. 5.

In the preferred embodiment of the invention shown in the drawings, the two sensor arrays are mounted on printed circuit boards 48 and 50, which form the outer housing of the sensor unit, and the boards 48 and 50 are connected together in spaced relationship by means of tape guide members 52, 54 to define the passageway 45. The guide members 52 and 54 are of suitable non-abrasive material and have aligned recesses in their inner faces comprising the tape guideways 46. The two boards have suitable electrical wiring 56 extending between them. The logic circuitry 19 is mounted on the outer face of one of the boards 50 and connected to the sensor outputs as explained in more detail below. An outer housing (not shown) may surround the sensor and control logic units for added protection, if desired.

Tape 10 may be of any suitable material of sufficient strength, for example metal tape with a dull or matte finish, or a plastic tape. Suitable reflective foil markers are applied to the tape to form the vanes. It has been found that a polyester or polypropylene tape of the type used for strapping is suitable, and in one specific example strapping tape of $\frac{5}{8}$ inches width and 0.025 inches thick was found to be suitable. This tape has a tensile strength of approximately 1200 lbs., has good wear resistance, and exhibits high fatigue resistance. Standard polyester and polypropylene strapping tapes have a surface which has some sheen, so that sheen is removed to provide a dull matte finish prior to hanging the tape in the elevator shaft. The reflective foil markers in the preferred embodiment of the invention comprise strips of a self-adhesive metallized tape such as Mylar (Registered Trademark).

Figure 6:
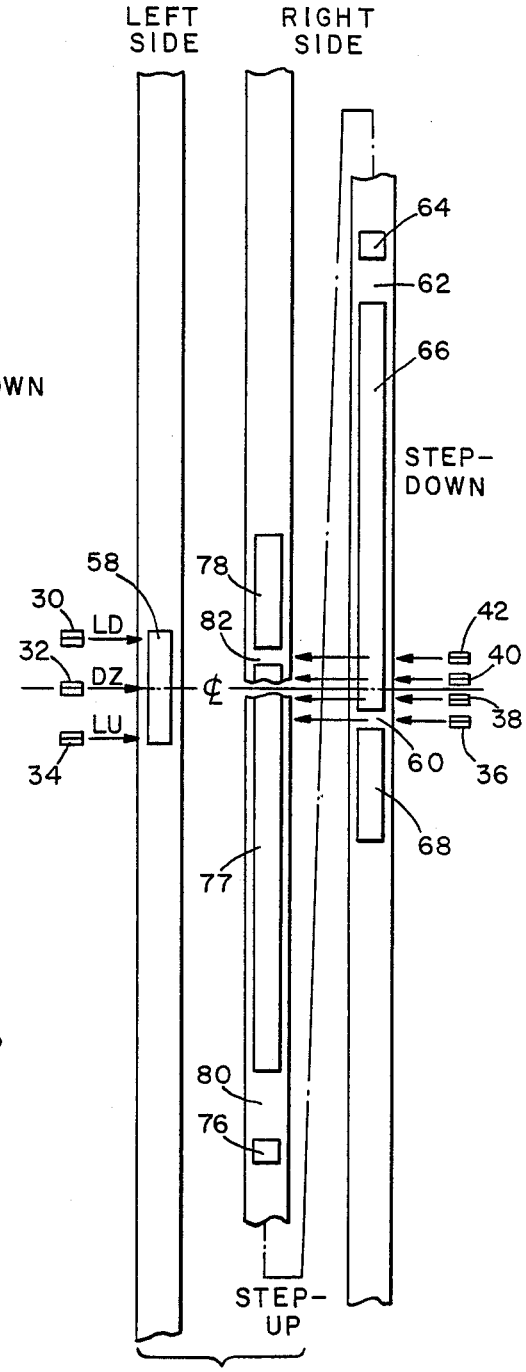
FIG. 6 illustrates the positioning of indicator vanes on opposite sides of the tape for a two-stop elevator installation.

Prior to installation of an appropriate length of tape in an elevator shaft, the lower landing vanes or reflective strips are applied. This is done by measuring approximately 16 feet from the end of the tape and marking that point with a pencil or other marker. This will be the centerline of the door zone vane. Approximately 10 inches of reflective foil is applied symmetrically to the tape about the marked centerline. The foil is then cut symmetrically about the centerline to provide a 7.5 inch length door zone vane 58, as seen in FIGS. 4 and 6. The significance of the vane length will become clear in the description of the system operation below.

The tape is then turned over, and a door zone vane centerline is applied on the opposite face. For convenience, the face of the tape on which the door zone vane is applied is referred to as the left hand face while the opposite face is referred to as the right hand face. A length of approximately 29.5 inches above the door zone centerline is then measured, and marked with a pencil or other marker. Foil is then applied to the right hand face from the latter mark, called the start mark, continuously to a point 10 inches below the centerline mark. Two gaps are then cut in the continuous strip of reflective tape, the first gap comprising a one inch gap approximately 7.38 inches from the lower end of the tape (gap 60 as seen in FIG. 6), and the second gap comprising a three inch gap approximately 1.5 inches from the start mark (gap 62 in FIG. 6). This provides the floor approach or step down vanes for the lower landing of a two door elevator system. The vanes on the right hand side of the tape in the vicinity of the lower door zone vane 58 comprise a short, 1.5 inch preamble vane 64, a long vane 66 of about 25 inches in length, and a final vane 68 of approximately 7.38 inches in length. These vane lengths and spacings are based on the spacings between the floor approach sensors and the desired point of slowing down the elevator motor, and are therefore given by way of example only. Clearly the vane lengths and spacings would be altered for different sensor arrangements. The significance of the length of the vanes and gaps between adjacent vanes will become clear from the detailed description of the system operation.

The upper landing door zone and landing or floor approach vanes are mounted after the tape is installed in the elevator shaft. The tape must be vertically suspended in the elevator shaft so that it extends from the top to the bottom of the hoistway in a fixed position to one side of the elevator car and parallel to the path of travel of the car. The tape is secured to suitable hangers 70 mounted on top and bottom cross support brackets 71, as shown in FIG. 1, which are secured as close as possible to the extreme ends of the elevator guide rails 72. The tape is installed as follows. When the cross support brackets have been mounted at opposite ends of the elevator shaft guide rails, and the lower level vanes have been placed on the tape as described above, the elevator car is positioned several feet below the top landing at a good working distance from the top tape cross support bracket. The tape is then threaded through the tape guides 52 and 54 from the top, and allowed to hang freely to the bottom of the hoistway with the premarked vanes below the car.

Figure 2:
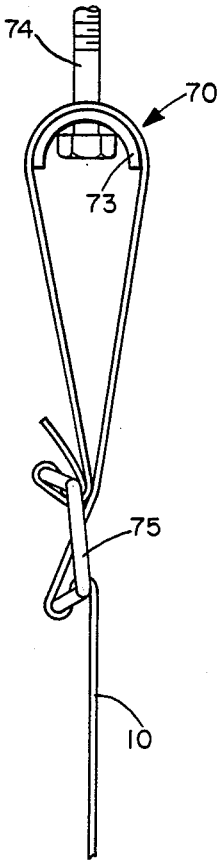
FIG. 2 is a more detailed view showing the mounting of the tape of the system shown in FIG. 1 at the top or bottom of the elevator shaft.

At this point the tape is secured to the tape hanger as shown in FIG. 2. The hanger basically comprises hanger member 73, and hanger bolts 74 securing opposite ends of the hanger member to the support bracket. A buckle 75 is provided for securing the free end of the tape. The tape is threaded through the top strapping buckle 75, over the hanger member 73 between the bolts 74, and threaded back through the buckle 75, leaving four to six inches of space between the hanger member and buckle. Downward force is applied to the tape to test the buckle connection.

The elevator car is now lowered slowly to the lowermost or first floor landing, ensuring that the tape does not knot up below the tape guides as the car descends. The top landing buckle is then adjusted until the door zone or floor level vane 68 is centered in the sensor guides to about +0.5 inches, i.e. approximately the same amount of vane projects out from each end of the sensor guideway.

The tape is then secured to the bottom hanger and strapping buckle, repeating the procedure used at the top hanger to thread the tape through the buckle, hanger, and then back through the buckle for tightening. At this point the tape is tensioned by tightening the bottom hanger bolts to a tension of 10 to 20 lbs. The centering of the lower door zone vane is then rechecked and adjusted, if necessary, by adjusting the top and bottom hanger bolts. When this adjustment is complete, lock nuts are tightened on the hanger bolts.

The reflective strips or vanes are now applied to the tape in the upper floor position. The car is raised to a level position at the upper floor landing. The tape is marked on its left hand face at a position just above and just below the sensor unit tape guideway. The car is lowered several feet and a 7.5 inch strip of reflective foil is applied to the marked door zone area. This latter strip comprises the upper door zone vane, which is identical to the lower door zone vane. On the opposite, right hand face of the tape a continuous length of reflective foil is applied from a starting point 10 inches above the door zone centerline to an end point 31 inches below the door zone centerline. Gaps are then cut in the tape to form the step up or floor approach vanes shown in the center of FIG. 6. These are similar in length to those of the step down vanes 64, 66 and 68, and comprise a short, preamble vane 76, a long, center vane 77, and a final vane 78. The gap 80 between the preamble vane and the center vane is 4.5 inches, and thus longer than the equivalent gap 60 in the step down vanes, as can be seen in FIG. 6. The gap 82 comprise a one inch gap located approximately 7.38 inches from the start point. At this point the system is operated to check if the car will level correctly at the landings. If adjustments are necessary to either of the door zone vanes, the car is levelled at the bottom landing and the upper and lower hanger bolts are readajusted to center the lower door zone vane about the tape guides. The car is then levelled at the upper landing, and, if necessary, the upper door zone vane positioning is adjusted by adding small lengths of reflective foil at either end of the vane and trimming the length as required to maintain an overall length of approximately 7.5 inches.

The purpose of the step up (STU) and step down (STD) vanes and associated sensors is to provide appropriate signals to the elevator controller hardware to slow down the elevator as it approaches a landing, to avoid a sudden stop from the relatively high speed of travel which could jolt elevator passengers. The slower speed approaching a landing is called the leveling speed, and the STU/STD vane length of 25 inches, measured to the door zone center line, is based on a leveling speed of approximately 6 feet per minute. The elevator leveling speed must therefore be adjusted to close to this value on installation of this elevator position sensing system.

As explained above, each set of floor approach vanes comprises a short, preamble vane 64, 76 of approximately 1.5 inch length, a long vane 66, 77 of about 25 inches in length with a gap of 3 inches and 4.5 inches, respectively, between the preamble vane and the long vane, and a final vane 68, 78 of approximately 7.38 inches length with a gap of about 1 inch between the long vane and the final vane. FIG. 6 shows the relative positions of the step down set of vanes and the lower door zone vane, and the step up set of vanes and the upper door zone vane.

If on running the elevator with the sensing system installed it is found that the car travels for an excessive time after slowing down to leveling speed, the step up and step down long vanes, which will each be about 25 inches long, can be shortened, taking care that the 4.5 inch and 3 inch gaps between these vanes and the adjacent preamble vane are preserved. Thus, if 2 inches were removed from the step up long vane, the preamble vane position would have to be adjusted accordingly.

After completion of all vane centering adjustments, lateral adjustment of the tape is made to ensure that the tape is accurately centered in the tape guides. With the car at the top landing, the tape is laterally adjusted in the top hanger so that the tape is not forced against the sides of the guides. The bottom hanger is similarly adjusted with the car at the bottom landing. This adjustment is not as critical as that at the top landing, where the sensor guides will be positioned much closer to the hanger.

The installation of a four-floor or multi-floor elevator position sensing system will be much the same as described above for a two door installation, but with the addition of extra marking vanes for the floor number coding and some modification of the step up and step down vanes, as explained in more detail below. Clearly this technique can be used for installing a tape and marking and securing any chosen arrangement of reflective vanes for suitably indicating the door approach, door zone level, and floor number (if necessary). Thus alternative arrangements of sensors and reflective vanes may be provided in alternative embodiments of the invention, and the embodiments described below comprise some examples of suitable sensor and vane arrangements for providing suitable elevator control signals.

Figure 9:
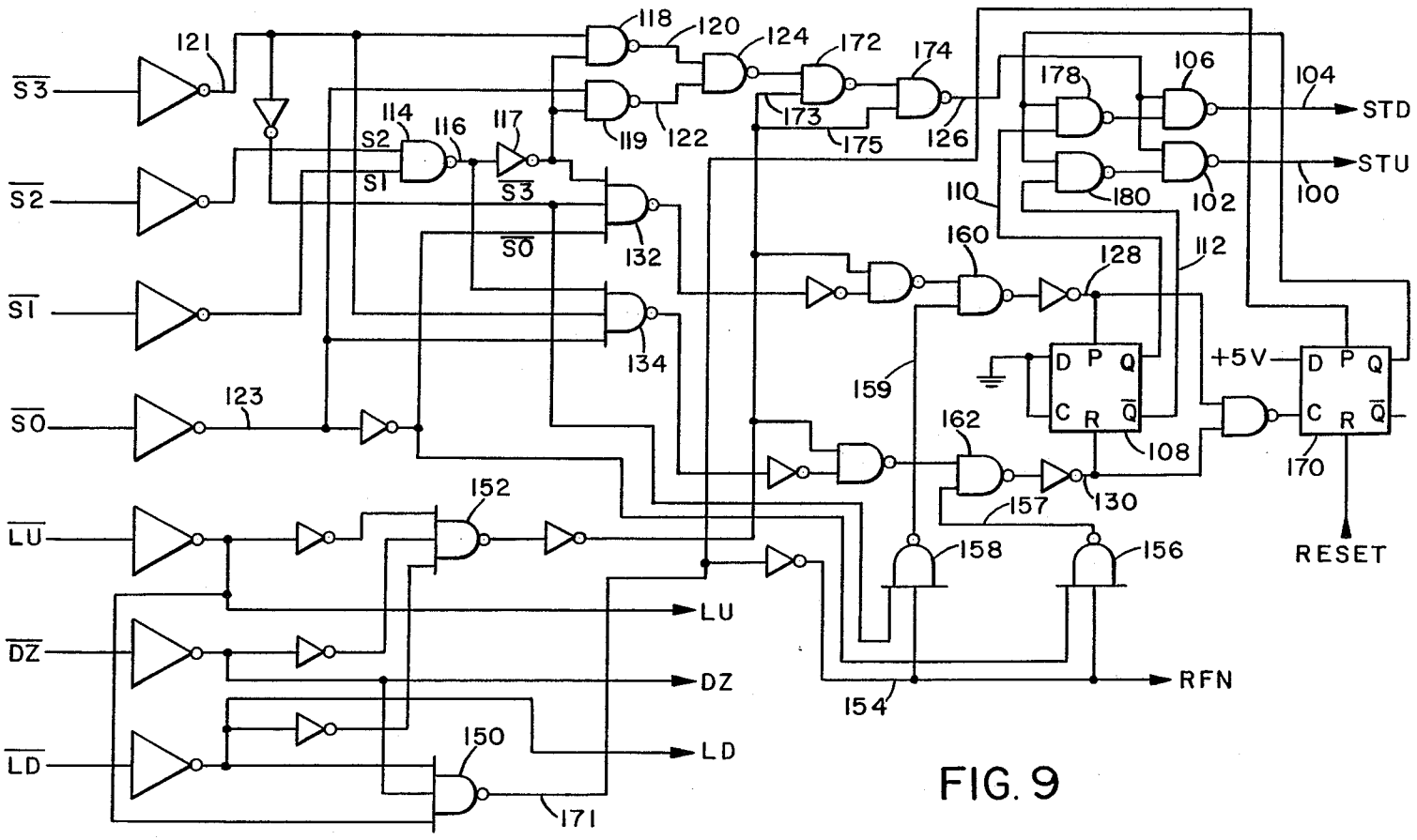
FIG. 9 is a more detailed block diagram of the gate array or control logic unit of the sensing system for a two-floor installation.
Figure 10:
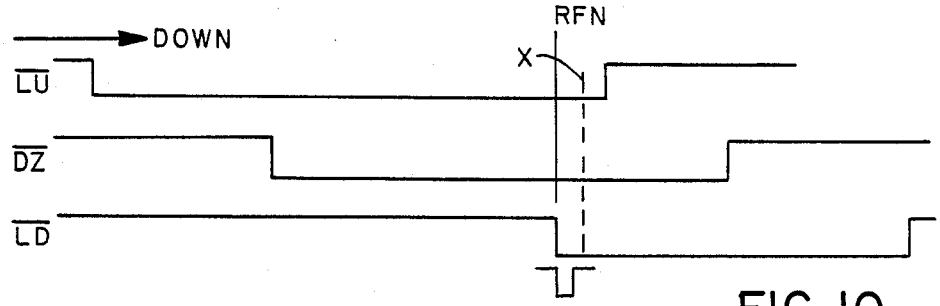
FIG. 10 is a timing diagram showing the floor level positioning signals.
Figure 11:
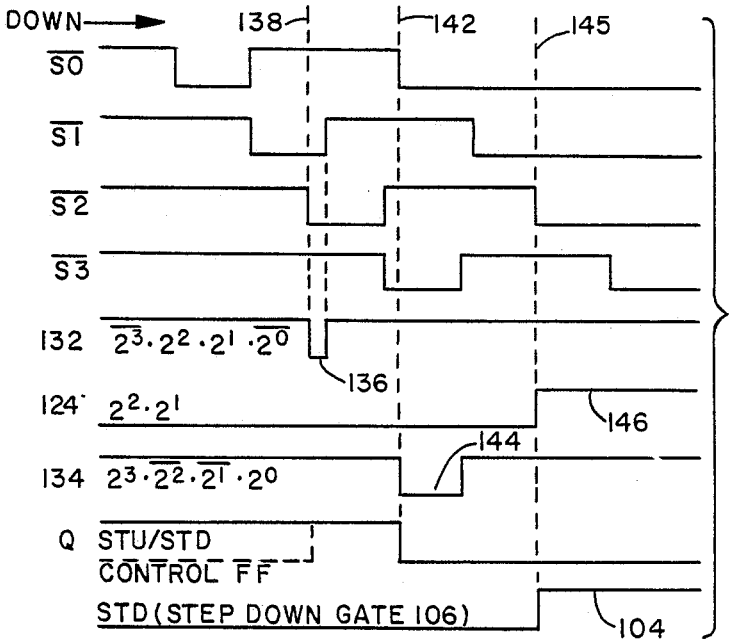
FIG. 11 is a timing diagram showing the production of the step down motor control signals.
Figure 12:
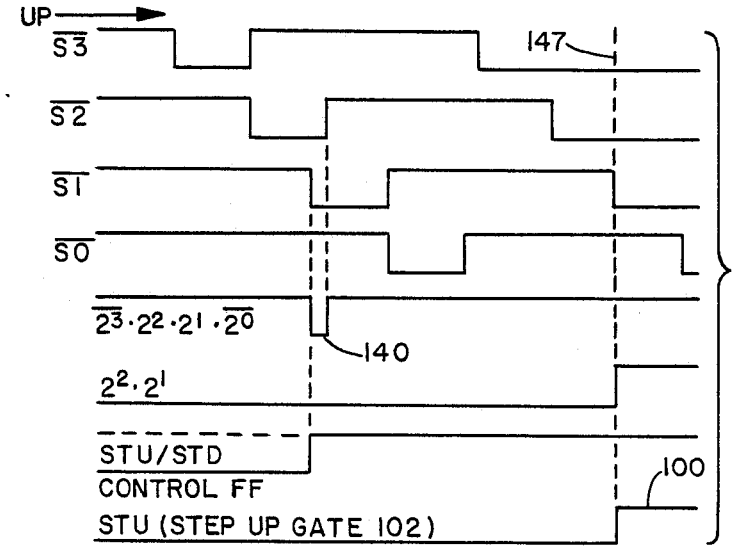
FIG. 12 is a timing diagram showing the production of the step up motor control signals.

Operation of a two-floor elevator system incorporating the position sensing system described above will now be described in more detail with reference to FIGS. 8 to 11. FIG. 8 is an overall system block diagram, while FIG. 9 is a more detailed block diagram of the gate array unit 94 of control logic circuitry 19. FIGS. 10 to 12 are timing diagrams representing the sensor outputs and corresponding signals at various points in the gate array circuit, as explained in more detail below.

Referring first to FIG. 8, the various sensor outputs are connected to the logic circuitry 19 which provides suitable output control signals which are connected to an elevator relay controller 23 which controls movement of the elevator by suitable operating elevator motor 25. The logic control circuit 19 generally comprises a gate array logic unit 94, described in more detail below with reference to FIG. 9, a delay unit 96, and relay drivers 98. The gate array logic module of FIG. 9 in the preferred embodiment of the invention is provided in the form of a single, custom gate array semiconductor chip.

As shown in FIG. 9, the floor level sensors and step up/step down sensors on opposite sides of the tape guideway are connected to the gate array unit inputs LD, DZ, LU, S3, S2, S1 and S0, respectively, in FIG. 9. The upper half of the gate array unit is arranged to generate the step up and step down control signals, while the lower half transmits the door zone sensor outputs to corresponding gate array unit outputs DZ, LU and LD for connection to the appropriate relay driver directly or via the delay unit 96 as shown in FIG. 8. Interconnections between the lower and upper half of the circuit in FIG. 9 are provided for reorientating the system following power outages and to control the STU and STD signals when the elevator is in the door zone area, and for simplicity the normal circuit operation will first be described without reference to these interconnections.

The operation of the door zone sensor outputs to control stopping of an elevator when the floor level is reached will first be described. The gate array unit does not modify these signals in any way, apart from providing suitable signals to the step up/step down part of the circuit as mentioned above. The basic door zone leveling signals are provided from the outputs from sensors 30, 32 and 34 which are labeled in FIGS. 8, 9 and 10 as LD (level down), DZ (door zone), and LU (level up).

The length of door zone vane 58 (FIG. 6) is arranged to be slightly greater than the distance between the outer two sensors 30 and 34, called the "level down" and "level up" sensors, respectively. In the preferred embodiment described the outer two door zone sensors are separated by about 6.75 to 7.0 inches, and the door zone vane length is about 7.5 inches, as explained above. However, other sensor separations and door zone lengths could be used to produce equivalent control signals in alternative embodiments. Door zone vanes are installed to be symmetrical about the door zone sensors, so that when all three sensors are on the vane, the elevator is levelled at the door, as explained in more detail below. The elevator controller is operated to stop the elevator drive motor when the output of all three door zone sensors is negative.

FIG. 10 is a timing diagram showing the output signals labeled $\overline{D}$, $\overline{DZ}$ and $\overline{LU}$, respectively, produced from each of the three sensors 30, 32 and 34 as they move past a door zone vane 58. The elevator is level at a floor when all three sensors are on the vane, i.e. at position X shown in FIG. 10. As shown in FIG. 8, the output signals LU and LD are connected to the relay driver unit through delay unit 96 to produce delayed signals LU' and LD', respectively, while the DZ signal is connected directly to the relay driver. When a respective input signal to the relay driver unit is high, the corresponding relay driver produces a corresponding low output signal level, which in turn operates a corresponding relay of the relay controller by pulling one end of the relay coil to ground. The other end will be at +24 Volts or +48 Volts depending on the system. The relay controller operates such that when the control outputs LU" and LD" are low and DZ is high simultaneously, indicating that all three sensors are on a door zone vane, the elevator motor and/or valve is switched off.

The delay in the level up and level down signals is provided so that the elevator car will not stop immediately as the final sensor moves onto the door level vane. For example, referring to FIG. 6, if the elevator car is moving down to the bottom or lower floor, and the valve was stopped as soon as LD sensor 30 moved onto the upper edge of the lower door zone vane, any slight lessening of load in the elevator car as the passengers move out, for example, would cause the sensor 30 to move off the vane, causing the valve to be energized in an attempt to level down the car.

For correct leveling of the car at the door zone, the relay controller operates such that when the output control signals indicate that two of the three door zone sensors are on the door zone, it will level the car up or down slightly to move all three sensors onto the vane. Thus, the delay in the LU and LD sensor signals will eliminate continual hunting, or turning on and off of the elevator hydraulic pump motor and/or valve. It has been found that a delay that the car moves and sensing system about ¼ inch past the vane edge will be sufficient to eliminate instability, so that a considerable addition or lessening of load is needed before the transition point of the vane is reached. This is appropriate where the door zone vane is of length approximately 7.25 to 7.5 inches while the distance between the LU and LD outer sensors is about 6.75 to 7.0 inches. Thus the elevator will actually stop at point X in the timing diagram of FIG. 10, where the final sensor moving onto the vane has proceeded ¼ inch past the start of the vane. Similarly, where the elevator is moving up to the top floor, the elevator will be stopped when the final sensor 34 has moved about ¼ inch onto the upper floor door zone vane, to eliminate hunting as a result of increased load as passengers step onto the elevator. For this reason, the length of the door zone vane should be approximately 0.5 to 0.75 inches greater than the spacing between the outermost two door zone sensors, such that when the elevator is stopped each of the two end sensors will be approximately ¼ inch from the adjacent vane edge.

In a two-floor elevator system, the elevator will always stop as soon as it reaches a floor, as it can only move up from the bottom floor to the top floor, or down from the top to the bottom floor. The control logic circuitry and door level approach signals required are therefore much simpler than for elevators having more than two floors, since there is no need to instruct the elevator controller to ignore door approach signals for intermediate floors where the elevator does not have to stop. The block diagram shown in FIG. 9 represents a simplified gate array circuit suitable for handling the outputs from the various sensors in a two floor system to produce the desired LU, DZ, LD, STU and STD output signals for connection to the relay drivers.

The production of the step up and step down control signals will now be described in detail with reference to the upper half of FIG. 9 and the timing diagrams of FIGS. 11 and 12. As shown in FIG. 9, the step up signal 100 (STU) is produced at the output of step up NAND gate 102 while the step down signal 104 (STD) is produced at the output of step down NAND gate 106. Step up/step down control flip flop 108 has its non-inverted and inverted outputs 110, 112 connected to step down NAND gate 106 and step up NAND gate 102, respectively, to control whether a step up or step down signal is produced.

As shown on the upper left hand side of FIG. 9, the $\overline{S2}$ and $\overline{S1}$ sensor outputs are connected via inverters to a two input NAND gate 114, the output 116 of this gate being tied via inverter 117 to a pair of NAND gates 118, 119, one of which has the $\overline{S3}$ sensor output as its second input and the other of which has the $\overline{S0}$ sensor output as its second input. The outputs 120, 122 from these two gates are connected to NAND gate 124, and the output 126 from gate 174 is connected to the step up and step down NAND gates 102 and 106 to control the production of either a step up or step down signal as will be explained.

Referring back to the step up and step down NAND gates 102 and 106, it can be seen that the output of these gates will go negative whenever both of the two inputs are positive or a logic one. The step up and step down vanes and associated sensors are arranged to produce suitable signals for producing these outputs when the elevator is moving up to the top floor or down to the bottom floor, respectively. The outputs of control flip flop 108 which control whether a step up or step down signal is produced are dependent on the set input on line 128 and the reset input on line 130. These are basically controlled by the output of two three input NAND gates 132 and 134. Gate 132 has as its three inputs the non-inverted outputs of sensors S3 and S0 and the AND output of sensors S1 and S2 from gate 114, while gate 134 has as its inputs the inverted outputs of sensors S3 and S0 and the output 116 of gate 114.

The generation of the step up/step down signals by the gate array will best be understood with reference to the timing diagrams of FIGS. 11 and 12 and the step up/step down vane configurations shown in FIG. 6. FIG. 11 is a timing diagram illustrating the outputs from the right hand sensors 36, 38, 40 and 42, labeled $\overline{S0}$, $\overline{S1}$, $\overline{S2}$, and $\overline{S3}$, as they pass over the step down vanes as the elevator moves down from the top to the bottom floor. FIG. 12 shows the equivalent outputs as the sensors move over the step up vanes when the elevator is moving up to the top floor.

It will be understood that the logic circuitry of FIG. 9 represents only one possible technique for producing step up and step down control signals, and that alternative logic circuits may be used for producing equivalent control signals from the same combination of input signals.

As shown in FIG. 11, as each of the four sensors passes over the preamble vane 64 on moving down, a short duration signal 136, called the preamble signal, is produced at the output of NAND gate 132. Gate 132 basically detects the existence of the condition $\overline{S0}S1S2\overline{S3}$, which occurs as the sensors pass over the preamble vane. The four sensors have unequal spacings between them, with the gap between the center two being equal to approximately 1.25 inches while the gap between each outer sensor and the next adjacent sensor is about 1.5 inches. Since the preamble vane is 1.5 inches long, a point will eventually be reached when the outer two sensors are outside this vane while the center two are on the vane. This is point 138 in FIG. 11. At this point the short duration signal 136 in FIG. 11 will be produced at the output of gate 132, the length of the signal being equal to the time for which this condition is met, i.e. for as long as both sensor S2 and sensor S1 are detecting the preamble vane. A similar preamble signal 140 will be produced by the step up vanes as the elevator moves up to the top floor, as shown in FIG. 12.

The second three input NAND gate 134 in FIG. 9 produces an output signal 144 only when the sensors move over the step down vanes, in either direction. The short preamble signal 136, 140 is produced at the output of gate 132 when the elevator moves up or down over either the step up or step down vanes to switch the control flip flop output high in each case. This is shown in FIGS. 11 and 12.

Referring back to the outputs of the four sensors as the elevator is moving down, the outputs will each go low in turn as the sensor passes over the 3 inch gap 62. From a consideration of the sensor spacings, it can be seen that a point will eventually be reached at which the outer two sensors each lie on a vane (vanes 64 and 66, respectively) while the center two sensors lie in the gap 62. At this pont, shown at 142 in FIG. 11, the output from gate 134 will go low, yielding signal pulse 144 at its output. This signal will not be produced when the elevator moves over the step up vanes, since the condition $S3\overline{S2}\overline{S1}S0$ will not occur because of the 4.5 inch gap 80 between preamble vane 76 and vane 77 (see FIG. 12). Thus, when the elevator is moving down, referring back to FIG. 11, the leading edge of signal 144 will flip the control flip flop Q output low and the $\overline{Q}$ output high, enabling the step down gate 106. Subsequently, as soon as both the S2 and S1 sensors are on the long vane 77, producing signal 146 in FIG. 11 at the output of NAND gate 124, the step down signal 104 is produced at the output of the step down gate 106.

When the elevator moves up over the step up vanes, the flip flop will be held high following the preamble signal, and because of the 4.5 inch gap no reset signal will be produced by NAND gate 134 (since the condition where both center sensors are on the gap while the outer two are on the vanes will not be met). Thus step up gate 102 rather than step down gate 106 is enabled by the output of the step up/step down control flip flop. As soon as both of the two central sensors are on the long vane 77, step up signal 100 will be produced at the output of step up gate 102. The length of the step up and step down signal is dependent on the length of the respective long vanes 66 and 77. Shortening of the vane will result in an elevator speed reduction to leveling speed at a position closer to the door zone, i.e. a shorter distance of travel at the reduced leveling speed.

Thus, the 3 inch and 4.5 inch gaps provided in the step down and step up vanes are used to produce two distinct speed reducing control signals, depending on whether the elevator is moving up or down. This is not as complex when there are only two floors, but becomes more complex where a greater number of floors is involved, as will be explained with respect to the multi-floor systems described below. In systems having more than two floors the distinct step up and step down signals enable the elevator controller to determine whether the elevator is moving up or down, and thus to keep track of the floor number and to avoid slow down in speed as the elevator approaches and passes an intermediate floor.

Since in the two floor system the long step up and step down vanes extend past the door zone area, the step up and step down relays will be actuated up to this point. The additional one inch gaps 60 and 82 are provided to allow the elevator controller to determine the location of the elevator car in the event of a power outage. The signals produced by these gaps when the elevator is level at a floor are used to either set or reset the control flip flop 108 so that it is orientated correctly for subsequent operation of the step up/ step down control outputs. As can be seen in FIG. 6, the gap 60 in the step down vanes is aligned with the lowermost, or S0, sensor when the elevator is stopped at the door zone. The gap 82 is aligned with the uppermost, or S3, sensor when the elevator is stopped at the upper floor door zone. Thus, from the outputs of the sensors S3 and S0 when the elevator is level at a floor, the control logic determines whether the STU and STD signal should be fed to the relay controller to control the elevator direction accordingly.

As shown in FIG. 9, two three input NAND gates 150, 152 are provided in the lower half of the gate array circuit, one of which has the signals LU, DZ, and LD as its three inputs and the other of which has the inverted signals LU, DZ and LD as its three inputs. The inverted output 154 of gate 150 is provided as one of the inputs of each of a pair of two input NAND gates 156 and 158. NAND gate 156 has the non-inverted output of the S0 sensor as one of its inputs, while NAND gate 158 has the non-inverted output of the S3 sensor as one of its inputs. Thus the gates 156 and 158 are controlled by the location of the gap 60 or 82 when the elevator is in a door zone. The input 154 will be positive only when the car is level at a door zone, enabling the two gates 156 and 158. At this point, if the car is at the lower floor, the other input of gate 156 will be a logic one since the sensor S0 will be detecting gap 60. Thus the output 157 of gate 156 will go to logic zero while the output 159 of gate 158 stays positive. Similarly, if the car is level at the upper floor, the non-inverted $\overline{S3}$ signal will be positive due to detection of gap 82 and gate 158 will produce a logic zero output. The outputs of gates 158 and 156 are connected to inputs of NAND gates 160 and 162, respectively, the outputs of which are connected to the set and reset inputs, respectively, of the step up/step down control flip flop. The other input of each of the gates 160 and 162 is the inverted output of NAND gates 132 and 134, respectively. Thus, if the elevator is at the lower floor when power is restored, the flip flop will be reset via the signal applied from NAND gate 162, and if the elevator is at the upper floor when power is restored, the flip flop will be set via NAND gate 160, so that the flip flop achieves the proper sense of the floor location for future operation of the step up/step down control outputs.

When power is lost between floors while the center two sensors on the right hand side are still detecting the long step up or step down vane, subsequent restoration of power would result in a step up or step down control signal at the upper half of the gate array circuit, resulting in the elevator motor running at the low leveling speed even if it is moving away from a floor. To avoid this, anything which may otherwise look like step up or step down information is inhibited if, at the time power is restored, any one of the door zone sensors detects the door zone vane. This is done via door zone NAND gates 150 and 152 and an additional flip flop 170 to the right of the step up/step down control flip flop 108 in FIG. 8.

The three input NAND gate 152 has as its inputs the non-inverted outputs of the level up, door zone and level down sensors. If any one of those sensors is on a door zone vane, the output of this gate becomes a one and the inverted output becomes a zero. This inverted output is connected to inputs 173 and 175 of NAND gates 172 and 174 at the top of FIG. 9, which are also connected to the output of step up/step down control NAND gate 124. Thus when inputs 173 and 175 are zero, the output of gate 124 is inhibited and any inputs to the step up and step down NAND gates 102 and 106 in the upper right hand corner of FIG. 9 are cut off. When input 173 is one, and the output of gate 124 is also 1, the output of gate 172 will be a zero and thus the output of gate 174 will be a one to produce the step up or step down signal according to the output of flip flop 108.

The NAND gates 178 and 180 to the left of gates 102 and 106, respectively, are to inhibit gates 102 and 106 in the event of a power outage outside the door zone vane while the center two right hand sensors are still on the long step up or step down vane. The Q output of flip flop 170 is tied to one input of each of the gates 178 and 180, while the other inputs of these gates are tied to the Q and inverted Q outputs, respectively, of the step up/-step down control flip flop (108). Thus these control outputs will be ineffective whenever the Q output of flip flop 170 is a zero. The set input 171 of flip flop 170 is provided from the NAND gate 150 in the lower left hand corner of FIG. 9, which will have a logic zero output, unless all the door zone sensors are on the door zone. Thus, if power is restored between floors, the elevator controller will run the elevator at high speed until a STU or STD vane is reached.

The control logic circuitry illustrated in FIG. 9 is a simplified circuit showing only the gating required to produce the necessary output control signals for a two floor elevator system. In the preferred embodiment of the invention the gate array unit 94 includes additional circuitry to enable the system to be switched between two and multi-floor elevator operations. Thus one common position sensing system, including the same sensor and control logic units, will be adaptable for two stop or multi-stop use. Where there are more than two floors in an elevator system, the sensor system must additionally be able to detect and keep track of the actual location of the elevator, so that when the elevator is travelling between floors the elevator controller will stop it only when the desired floor destination is reached. Thus the elevator controller, which in a multi-floor system may be a relay controller or a microprocessor controller, includes a suitable counter for keeping track of the floor number.

The multi-floor elevator position sensor system is substantially the same as the two floor system, with the same sensor assemblies and sensor spacings. However, additional vanes are mounted on the tape 10 for denoting the floor number, and the step up and step down vanes are also different to allow multi-floor operation.

Figure 7:
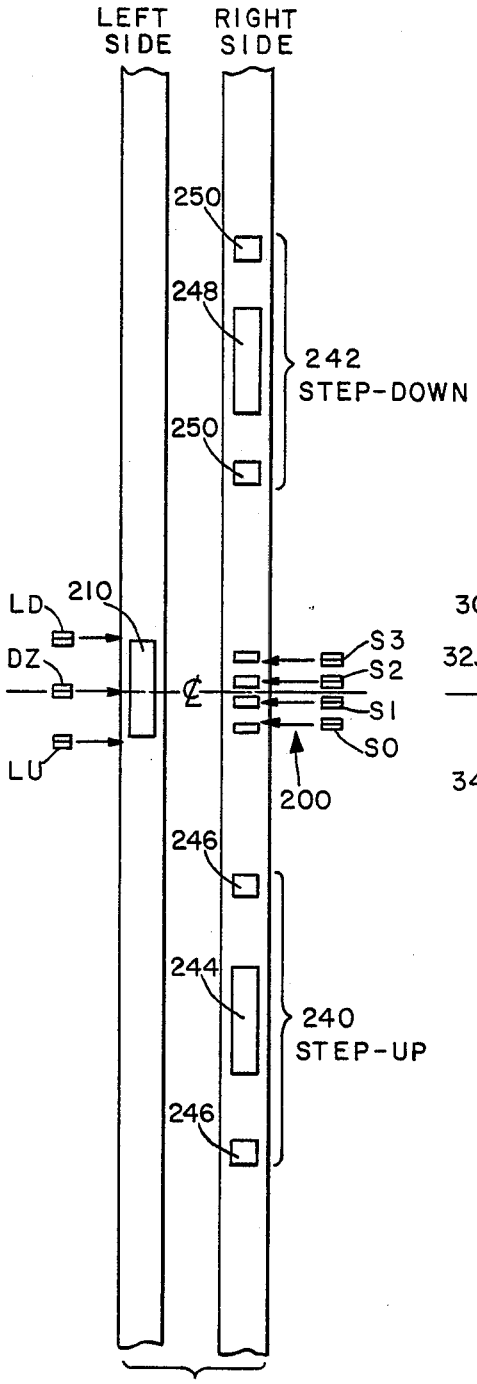
FIG. 7 illustrates the positioning of indicator vanes on opposite sides of the tape for a multi-stop elevator installation.

The vane arrangement for a multi-floor system for producing output control signals for connection to a 1230 type elevator controller is shown in FIG. 7 of the drawings. The vanes, sensors, and logic circuitry are preferably arranged such that the output control signals produced by the relay drivers are directly compatible with existing microprocessor elevator controllers opeated by the old vane type elevator position sensors. Thus, referring to the block diagrams of FIGS. 8 and 14, the logic unit 94 has additional (floor number) control outputs comprising the outputs S3, S2, S1 and S0 from the four sensors and the RFN or read floor number output indicating that an elevator is level at a floor and that the floor number is valid. The outputs of the control logic unit are arranged to be connectable directly to an existing microprocessor controller to operate the elevator system. This makes the position sensing system particularly easy and convenient to install in an existing multifloor, microprocessor controlled elevators, and allows the use of existing microprocessor controllers in new elevator systems incorporating the sensor system of this invention with little or no modification being required.

The multi-stop system includes a series of vanes 200 known as the floor number vanes (see FIG. 7). These vanes are located at the right side of the tape 10 for detection by the four right hand sensors when the elevator is in the door zone. The vanes are arranged to produce a binary code such that the output from the four sensors S0, S1, S2 and S3 when the elevator is at a floor will be equal to the binary coded number equivalent to that floor. The first sensor output represents $2^0$, the second sensor output represents $2^1$, the third sensor output represents $2^2$, and the final sensor output represents $2^3$. Thus, whenever a door zone signal is produced from the door zone sensors, the logic unit produces a "read floor number" signal at the RFN output which instructs the microprocessor to read the outputs from the four right-hand sensors at that time. If no reflective vanes are detected in the area 200 when the floor number is read, the output will be a binary zero. If each sensor detects a reflective vane, as shown in FIG. 7, the output will be a binary 15. Thus each floor can be coded separately up to sixteen floors if the lowest floor is coded a binary zero, or up to fifteen floors if the lowest floor is coded as binary one. If an elevator system has more than sixteen floors, an extra sensor can be provided to allow coding of up to 32 floors. If the elevator has only four floors, only two of the four sensors on the right hand side will be required to detect the floor number, with the reflective tabs located to produce binary coded outputs from 0 to 3. However, the same number of sensors is preferably also used in the four floor system, with the arrangement of vanes providing the binary code being repeated twice at each floor so that each pair of sensors will produce a binary coded floor number output. This allows the floor location to be double checked against any potential errors, and also allows the same sensor and logic unit to be installed for elevator systems having any number of floors from two to sixteen.

Figure 13:
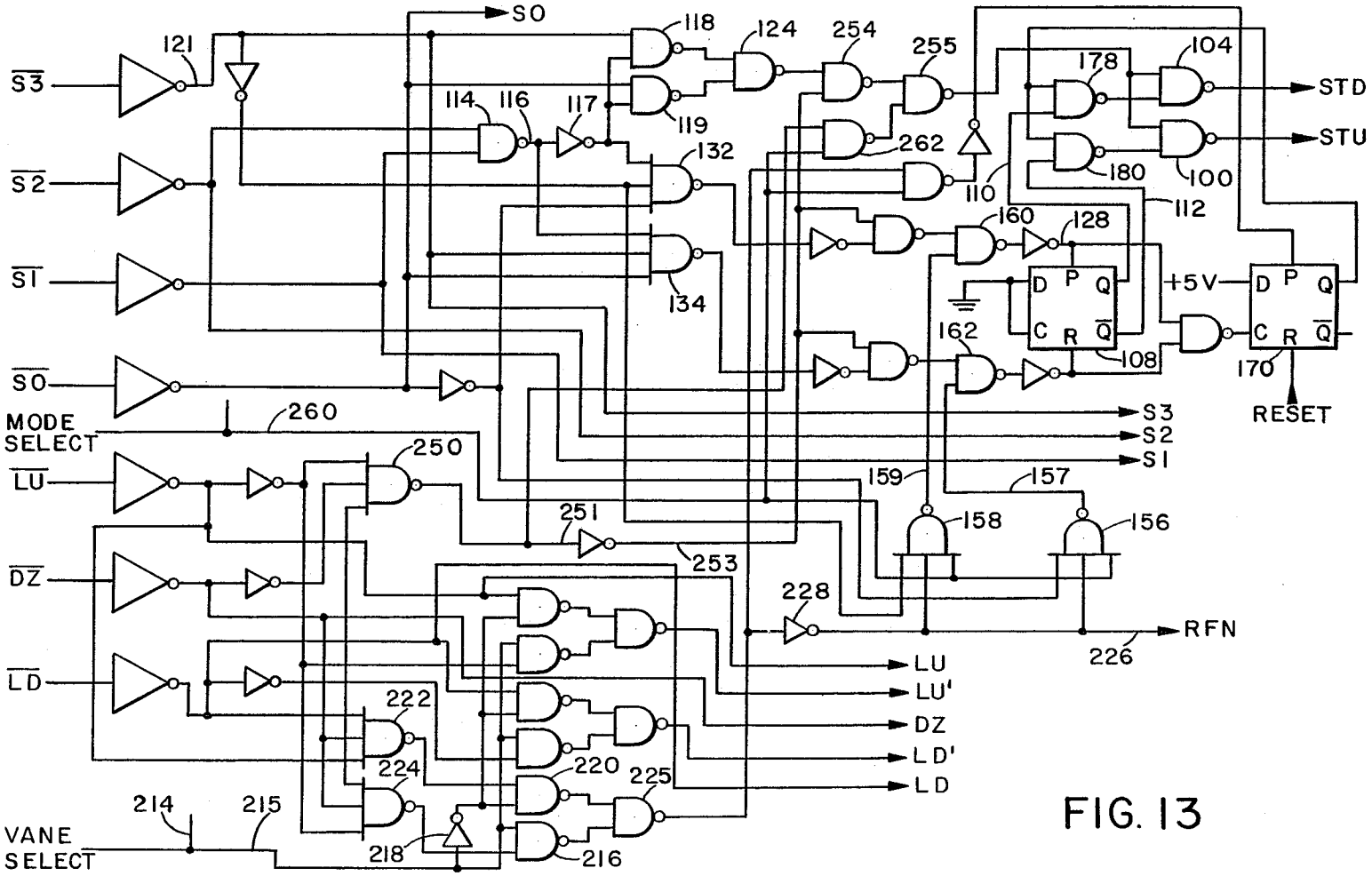
FIG. 13 is a block diagram similar to FIG. 9 showing a modified control logic unit for a two-floor or multi-floor operation.

Another difference in the vanes provided in the multi-floor system shown in FIG. 7 is that the door zone vane 210 is shorter. Thus the characteristic output signals from the three door zone sensors when the elevator is in the door zone will be a logic zero from the center sensor $\overline{DZ}$ while the outer two sensors $\overline{LU}$, $\overline{LD}$ will be off the vane and thus produce a logic one. This difference is simply for compatibility with the standard input control signals for operating the microprocessor controller normally used in multi-floor elevator systems. FIG. 13 is a more detailed schematic diagram of a gate array unit convertible between a two floor operation and a multi-floor operation. The logic control unit is provided with a vane control switch 214 for switching between a long door zone vane and a short door zone vane. This switch provides an input on line 215 connected to suitable control gating for switching the door zone detection circuitry between long door zone vane and short door zone vane detection. Input 215 is high for a short door zone vane and low for a long door zone vane. The input 215 is connected directly to a first NAND gate 216 and via an inverter 218 to a second NAND gate 220. Thus gate 216 will be enabled when input 215 is high, and gate 220 will be enabled when input 215 is low.

The two gates 216 (short vane) and 220 (long vane) determine which of the two three input NAND gates 222 and 224 in the lower left hand corner of FIG. 13 will produce an RFN signal 226 at the RFN output of the gate array logic unit. Thus gates 216, 220, 222, 224 and 225 effectively replace the single three input NAND gate 150 of FIG. 9. NAND gate 222 detects when all three door zone sensors are on a long door zone vane, producing a logic zero at the output when this condition is met, while NAND gate 224 detects when the center door zone sensor is on a short door zone vane while the outer two sensors lie outside the vane. In each case the outputs of the NAND gates 222 and 224 will remain positive unless the door zone condition is met, so that in the case of a long vane gate 224 will stay positive, and gate 222 will remain positive in the case of a short vane. Thus, in the case of a long door zone vane, the output of gate 220 will go to logic one when the gate 222 produces a zero output, and since the output of gate 216 will be one at all times, the output of RFN gate 225 will go to zero, producing the RFN output signal via inverter 228. Similarly, in the case of a short door zone vane, the output of gate 224 will go to zero when the door zone condition is met, producing a one at the output of gate 216 and thus a zero output from gate 225. This arrangement therefore allows the installer to select either a short door zone or long door zone vane operation using the same control logic circuitry. Clearly this part of the circuit could be omitted if only one door zone vane length was to be used, requiring only one of the two NAND gates 222 and 224 to provide the "RFN" output.

For a three or more floor system which is operated by a relay controller, rather than a microprocessor, the tape 10 will have long door zone vanes on its left hand face as shown in FIG. 6, with the step up, step down and floor number vanes on its right hand face as shown in FIG. 7.

The tape 10 used in an elevator system having more than two floors will have symmetrical step up and step down vanes 240 and 242, respectively, on each side of the door zone. These are shown in FIG. 7. The step up vanes comprise a central vane 244 approximately 7 inches in length with 1.5 inch preamble vanes 246 on each side of it with a gap of 4.5 inches between each preamble vane and the adjacent central vane edge. Similarly, the step down vanes comprise central vane 248 of 7 inches in length with short, 1.5 inch preamble vanes 250 at each end with a gap of 3 inches between each preamble vane and the adjacent central vane edge. The difference in length of the gaps in the step up and step down vanes is used in the same way as in the two floor system to produce either a step up control signal or a step down control signal from the gate array unit.

The gating in the upper half of FIG. 13 is used for producing the step up and step down signals following detection of the preamble vanes in much the same manner as described above in connection with FIG. 9, and like reference numerals have been used where appropriate. However, since the same four sensors are used to detect the step up and step down vanes as well as the floor number vanes, additional gating must be provided to avoid the elevator controller mistaking the floor number vanes for step up or step down vanes in the event, for example, that the particular floor number coding involves the outer two sensors detecting vanes while the center two sensors do not detect a vane.

This is done as shown in FIG. 13 by providing additional gating at the top half of the circuit, and by means of a mode select switch connected to line 260. Line 260 is connected to each of the three input NAND gates 156 and 158, and also to one input of NAND gate 262, the other input of which is connected to the non-inverted output of three input NAND gate 250 in the lower half of the circuit. For two floor operation, line 260 is connected to the positive supply, so that the gate 262 to which it is tied is permanently enabled, allowing the step up and step down relays to be effective into the door zone area, since there is no requirement for detecting the floor number with the step up and step down sensors in this case.

For a multi-floor operation, line 260 is grounded, inhibiting anything which might look like step up or step down information while the door zone sensors are detecting the door zone. The output 251 of gate 250 is connected to NAND gate 262 in the upper half of the circuit of FIG. 13, while the inverted output 253 is connected to NAND gate 254 which has the output of gate 124 as its second input. The outputs of gates 262 and 254 are connected to the two inputs of an additional NAND gate 255, which is itself connected to the inputs of step up and step down gates 100 and 104. Referring back to the description of FIG. 9, a step up or step down signal can be produced only if a logic 1 is produced at the output of gate 255. This occurs when at least one of the two inputs is logic zero.

If any one of the inputs of gate 250 is a zero, output 251 wil be a one and inverted output 253 will be zero. Since one of the inputs of NAND gate 262 is permanently zero when the mode select switch is connected to ground, the output of gate 262 will be held at one. At the same time, when the system is in the door zone, one input of gate 254 from line 253 will also be held at zero, ensuring that the output of gate 254 will also be a logic one, cutting off any inputs to the step up and step down NAND gates 100 and 104, since the output of gate 255 is held at zero.

The outputs S3, S2, S1 and S0 from the logic circuit in FIG. 13 are connected to the microprocessor controller in the case of a multi-floor, microprocessor controlled elevator and strobed each time a read floor number signal is produced to enable the controller to keep track of the elevator location. If the next floor will be the floor at which the elevator is to stop, the controller will begin looking for a step up signal (if it is moving up) or a step down signal (if it is moving down). This will reduce the speed, and the elevator will stop as soon as the door zone sensors indicate that it is level at the floor, i.e. when the door zone DZ signal is high while the delayed LU and LD signals are both low. If the door zone signal is high while only one of the other door zone sensors is low, the controller will operate the elevator motor to level the elevator up or down, depending on which of the two sensors LU and LD is detecting the vane.

In the event of a power outage when the elevator is level at a floor, the controller will read the floor number sensor outputs as soon as power is restored, since a read floor number signal will be produced by the door zone sensors. This enables the floor number counter to be preset to the correct floor number. The elevator direction can be determined on leaving a floor by detection of the step up or step down vanes. If a step up signal is produced, the controller determines that the elevator is moving down. If a step down signal is produced, the elevator will be moving up. The floor counter direction (UP or DOWN) is determined according to which of these two signals are detected on moving away from a floor.

If a power outage occurs between floors, the elevator is simply driven until a floor is reached. The step up or step down signal determines the direction of travel, while the floor number outputs will tell the controller where the elevator is located and allow the floor number counter to be correctly preset.

Figure 14:
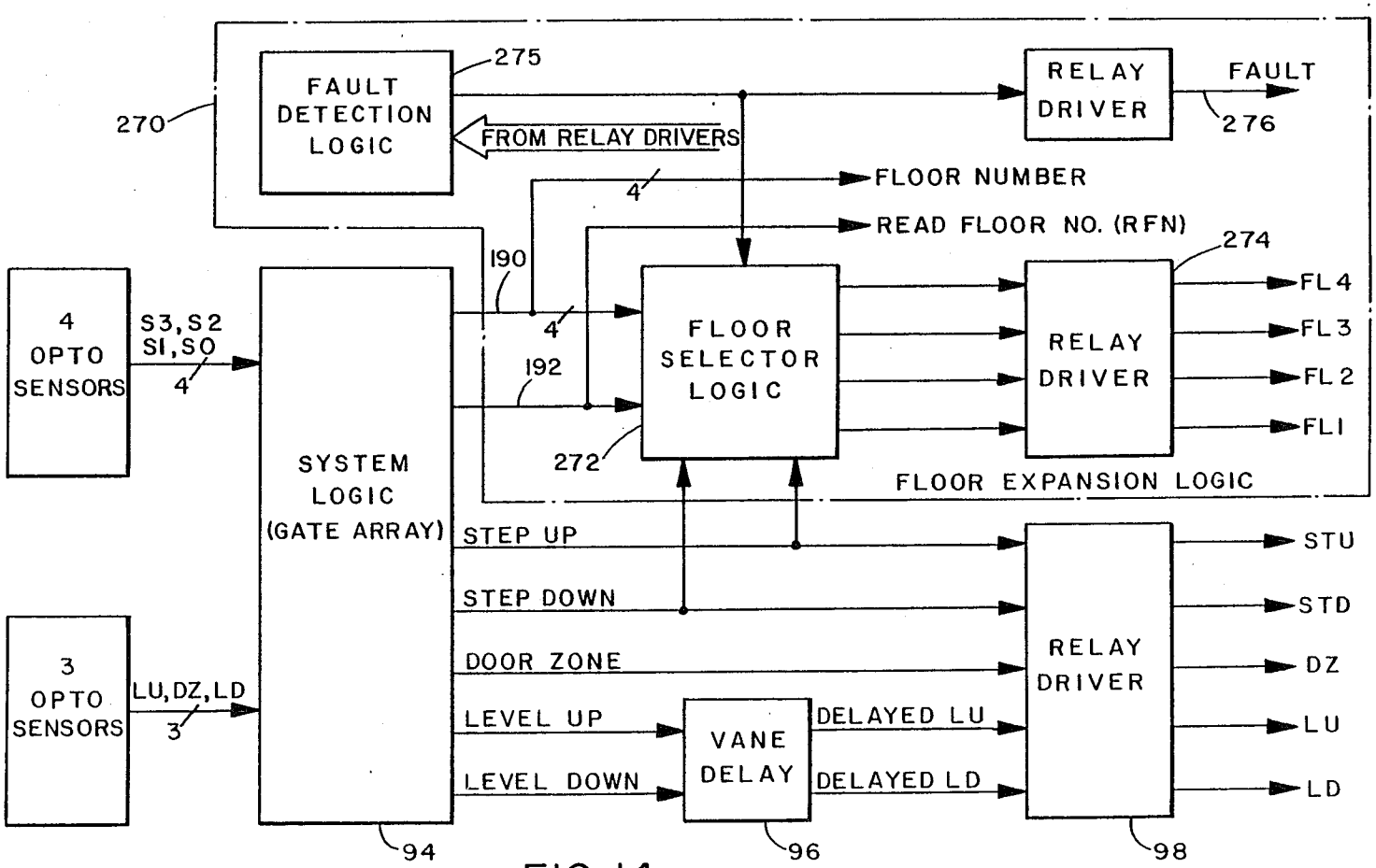
FIG. 14 is a block diagram similar to FIG. 8 showing a modification for a four-floor elevator system operated by a relay controller.

FIG. 14 is a modified block diagram similar to FIG. 8 but showing additional control circuits for a four floor elevator operated by a relay controller. In this case the control logic circuitry includes floor expansion logic 270 connected to the floor number and read floor number outputs 190 and 192 of the gate array unit 94, which will be substantially the same as shown in FIG. 13. The floor number outputs from sensors S3, S2, S1 and S0 are connected to suitable floor selector logic 272, along with the read floor number output 192. The floor selector logic determines the binary coded output from each pair of sensors when a read floor number signal is produced and also provides a suitable counter for keeping track of the elevator position. Corresponding control outputs the connected to the relay driver 274 to produce first, second, third and fourth floor signals FL1, FL2, FL3 or FL4 to the relay controller. Also shown in FIG. 14 is a suitable fault detection logic unit 275 for detecting when the outputs from the relay drivers 98 and 274 do not represent a possible output combination from the various sensors. For example, if the door zone sensors are detecting a door zone vane, while the floor number sensors are not detecting floor number vanes, a system error is indicated and the fault detection logic. will produce a corresponding error signal (FAULT) 276 to the elevator controller.

The elevator position reading sensor system of this invention is easier and faster to install and adjust than previous elevator position systems of the vane type. The entire sensor system can be installed in a single housing on the elevator car, and a single control logic unit or gate array is connected to the sensors to produce the desired elevator control signals according to the various possible combinations of sensor outputs. This is a lightweight, compact unit which can be easily removed and replaced whenever necessary. The same logic unit can be modified for two floor or multi-floor operations, and for connection to existing microprocesor or relay type elevator controllers, by the provision of two switches in the unit for controlling the mode of operation of the logic unit.

Thus the same basic position sensing system can be used for elevators having any number of floors. The system includes circuitry for reorientating the system following a power outage, and preferably includes some error detection circuitry.

Although some preferred embodiments of the invention have been described above by way of example only, it will be understood by those skilled in the field that modifications may be made to the disclosed embodiments without departing from the scope of the invention, which is defined by the appended claims.

I claim:

1. An elevator position reading sensor system, comprising:

a tape vertically mounted in an elevator shaft, said tape having two faces;

vanes mounted on both of said faces at predetermined positions relative to elevator landings;

a sensor unit mounted on the elevator car for detecting vane positions on both of said faces and producing output signals representative of the elevator car position relative to a respective landing in response to vane detection; and control means connected to the sensor unit for producing predetermined elevator motor control signals for controlling the speed and stopping of the elevator car.

2. The system as claimed in claim 1, wherein the control means conprises a gate array logic unit, the gate array logic unit and sensor unit being mounted in a single housing on the elevator car.

3. The system as claimed in claim 1, wherein the tape is suspended in an elevator shaft parallel to the path of elevator car travel along substantially the whole length of the shaft.

4. The system as claimed in claim 3, including adjustable hanger means for hanging the tape at the top and bottom end of an elevator shaft.

5. The system as claimed in claim 1, wherein the tape and the vanes are of different reflectance, the sensor unit comprising sensors for detecting the difference in reflectance.

6. The system as claimed in claim 5, wherein the tape is of relatively non-reflective material and the vanes are of reflective material, the sensor unit comprising an array of reflective object sensors for generating light and for detecting light reflected from the reflective vanes on the tape.

7. The system as claimed in claim 6, wherein the tape is a polyester strapping tape.

8. The system as claimed in claim 7, wherein the vanes are strips of self-adhesive metallized tape.

9. The system as claimed in claim 1, wherein the tape has vanes on both faces, the vanes on one face comprising floor level vanes and the vanes on the opposite face comprising floor approach vanes, and the sensor unit comprises a first set of door zone sensors positioned for detecting the floor level vanes and a second set of floor approach sensors for detecting the floor approach vanes, the control means comprising means for producing elevator stopping control signals in response to predetermined output signals from the door zone sensors, and means for producing elevator speed reducing control signals in response to predetermined output signals from the floor approach sensors.

10. The system as claimed in claim 9, the vanes further including floor number vanes in the door zone area representative of the respective floor number, the floor approach sensors further comprising means for detecting the floor number vanes and producing output signals representative of the respective floor number.

11. The system as claimed in claim 9, wherein the door zone sensors comprise three vertically spaced sensors and the door zone vanes comprise a single vane at a predetermined position relative to each landing for detection by the three sensors when the elevator car is located at each landing.

12. The system as claimed in claim 11, wherein each door zone vane is longer than the spacing between the outer two door zone sensors, the control unit comprising means for providing control signals for stopping the elevator at a selected floor when all three door zone sensors detect the door zone vane.

13. The system as claimed in claim 11, wherein each door zone vane is shorter than the spacing between the outer two door zone sensors, the control unit comprising means for providing control signals for stopping the elevator at a selected floor when the center door zone sensor detects the door zone vane while the outer two sensors are outside the vane.

14. The system as claimed in claim 11, wherein the control unit includes delay means for providing a predetermined delay in the elevator stopping control signals.

15. The system as claimed in claim 1, wherein the sensor unit comprises a series of vertically spaced sensors and includes guide means for vertically guiding the tape through the sensor unit.

16. The system as claimed in claim 15, wherein vanes are provided on both faces of the tape and the sensor unit comprises a first series of vertically spaced sensors on one side of the guide means for detecting the vanes on one face of the tape and a second series of vertically spaced sensors on the opposite side of the guide means for detecting the vanes on the opposite face of the tape.

17. The system as claimed in claim 16, wherein the sensor unit comprises a pair of spaced printed circuit boards on which the two series of respective sensors are mounted, and a spaced pair of guides extending between the circuit boards having grooves for receiving and guiding the opposite side edges of the tape with its opposed faces facing the oppositely directed series of sensors.

18. The system as claimed in claim 17, wherein the grooves have non-abrasive surfaces.

19. An elevator system, comprising:

an elevator car mounted in a hoistway for vertical movement between elevator floor levels;

a motor for driving the elevator car between the floor levels;

an elevator controller for controlling the operation, speed and direction of the elevator motor;

a tape vertically mounted in the elevator hoistway adjacent and parallel to the path of travel of the elevator car in the hoistway, said tape having two oppositely-directed faces;

a sensor unit mounted on the elevator car, the sensor unit having a passageway for guiding the tape through the sensor unit;

a series of vanes mounted on each of said faces of the tape at predetermined locations relative to each elevator floor level;

the sensor unit including sensor means mounted adjacent the passageway and responsive to said tape for detecting vanes on both faces of the tape passing through the passageway and for producing sensor output signals in response to vane detection; and a control unit for receiving the sensor output signals and for providing corresponding control signals to the elevator controller for controlling the elevator movement in response to the detected vane positions.

20. A method of installation an elevator position-sensing system in an elevator shaft, comprising the steps of:

providing a flexible tape having two oppositely-directed faces;

securing one end of the tape at one end of an elevator shaft;

threading the opposite end of the tape through tape guides in a sensor unit mounted on an elevator car in the elevator shaft;

securing the opposite end of the tape to the opposite end of the elevator shaft so that it extends vertically along the shaft parallel to the path of elevator movement; and mounting vanes on both faces of the tape at predetermined positions relative to each elevator floor level for detection by the sensor unit.

21. The method according to claim 20, wherein the step of mounting vanes on the tape comprises mounting floor level vanes of predetermined length on one face of the tape which are centered in the sensor unit at each floor level, and mounting floor approach vanes on the opposite face of the tape at predetermined distances from the floor level vane center lines.

22. The method according to claim 21, in which two different types of floor approach vanes are mounted on the tape, the first type comprising step up vanes positioned below each floor level except the lowermost floor and the second type comprising step down vanes positioned above each floor level except the uppermost floor.

23. The method according to claim 21, including the further step of mounting floor number vanes at each floor level on the opposite face of the tape to the floor level vane, the floor number vanes being coded according to the respective floor number at which they are mounted.

24. The method according to claim 23, in which the floor number vanes are binary coded.

25. The method according to claim 23, in which floor number vanes are repeated at each floor level to provide redundant floor number vanes for error detection.

26. The method according to claim 20, wherein the step of mounting the vanes on the tape comprises:

mounting a first set of vanes corresponding to the floor level at one end of an elevator shaft at a predetermined distance from one end of the tape;

positioning the elevator car at the floor level at which the vanes are mounted subsequent to installing the tape in the shaft;

adjusting the tape position until the vanes are centered in the sensor unit;

running the elevator car to another landing level;

marking the tape at that landing level;

moving the elevator car away from the landing level;

mounting the vanes for that landing level at predetermined positions relative to the markings on the tape; and repeating the operation to install the vanes for each landing level.

27. An elevator position sensing unit for mounting on an elevator car, comprising:

means for mounting the sensing unit on an elevator car;

sensor means for detecting the position of reflective vanes mounted on both sides of a flat tape running through the sensing unit and for producing sensor output signals in response to vane detection; and control logic means connected to the sensor outputs for connection to an elevator controller for controlling movement of the elevator car, the control logic means comprising means for detecting predetermined combinations of sensor output signals to produce elevator control signals to the elevator controller for stopping the elevator at a selectetd floor and for slowing down the elevator on approaching the selected floor level.

28. The sensing unit according to claim 27, wherein the control logic means comprises a gate array circuit.

29. The sensing unit according to claim 27, wherein the control logic means includes means for detecting the direction of elevator travel.

30. The sensing unit according to claim 28, wherein the gate array circuit comprise a single semiconductor chip.

31. The sensing unit according to claim 27, wherein the control logic means includes fault detection means for detecting errors in the sensor output signals and for producing a fault output signal in response to detection of an error.

* * * * *